US008328446B2

(12) United States Patent
Izawa et al.

(10) Patent No.: US 8,328,446 B2
(45) **Date of Patent: *Dec. 11, 2012**

(54) MECHANICAL PENCIL

(75) Inventors: Hirotake Izawa, Yokohama (JP); Takeo Fukumoto, Yokohama (JP); Norio Ohsawa, Yokohama (JP); Kyo Nakayama, Yokohama (JP); Yoshitoshi Osano, Yokohama (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 204 days.

This patent is subject to a terminal disclaimer.

(21) Appl. No.: 12/882,785

(22) Filed: Sep. 15, 2010

(65) Prior Publication Data

US 2011/0002728 A1 Jan. 6, 2011

Related U.S. Application Data

(63) Continuation of application No. 12/636,062, filed on Dec. 11, 2009, now Pat. No. 7,815,385, which is a continuation of application No. 12/308,079, filed as application No. PCT/JP2007/061178 on Jun. 1, 2007, now Pat. No. 7,654,763.

(30) Foreign Application Priority Data

Jun. 5, 2006 (JP) ..... 2006-156252

(51) Int. Cl.
*B43K 21/22* (2006.01)

(52) U.S. Cl. ..... 401/93; 401/92

(58) Field of Classification Search ..... 401/92–94
See application file for complete search history.

(56) References Cited

U.S. PATENT DOCUMENTS

| | | | | |
|---|---|---|---|---|
| 4,354,767 | A * | 10/1982 | Tessier | 401/63 |
| 4,411,543 | A | 10/1983 | Hashimoto et al. | |
| 6,481,908 | B2 | 11/2002 | Lychwick | |
| 6,702,495 | B1 | 3/2004 | Lychwick | |

FOREIGN PATENT DOCUMENTS

| | | |
|---|---|---|
| JP | 51-44029 | 4/1976 |
| JP | 52-50828 | 11/1977 |
| JP | 54-25339 U | 2/1979 |
| JP | 56-19382 U | 2/1981 |
| JP | 57-57985 U | 4/1982 |
| JP | 10-329485 A | 12/1998 |

OTHER PUBLICATIONS

International Search Report of PCT/JP2007/061178, mailing date of Aug. 14, 2007.
Chinese Office Action dated Dec. 4, 2009, issued in corresponding Chinese Patent Application No. 2007-800208313.

* cited by examiner

*Primary Examiner* — David Walczak
(74) *Attorney, Agent, or Firm* — Westerman, Hattori, Daniels & Adrian, LLP

(57) ABSTRACT

A chuck unit (4) for grasping a writing lead (10) and a rotor (6) arranged to be movable in a direction of rotation and an axial direction within a body cylinder (1) are provided. First and second cam faces (6*a*) and (6*b*) are respectively formed at one end face and another end face of the rotor in the axial direction, and first and second fixed cam faces (13*a*) and (17*a*) are arranged on the body cylinder side to face the first and second cam faces respectively. The first cam face in the rotor is brought into abutment with and meshed with the first fixed cam face by retreat operation of the chuck unit under writing pressure, and the second cam face in the rotor is brought into abutment with and meshed with the second fixed cam face by releasing the writing pressure, so that the rotor rotates, whereby the writing lead also rotates.

3 Claims, 15 Drawing Sheets

MECHANICAL PENCIL

CROSS-REFERENCE TO RELATED APPLICATIONS

This application is a Continuation of U.S. application Ser. No. 12/636,062, filed Dec. 11, 2009, subsequently issued as U.S. Pat. No. 7,815,385 on Oct. 19, 2010, which is a Continuation of U.S. application Ser. No. 12/308,079, filed Dec. 5, 2008, U.S. Pat. No. 7,654,763, issued Feb. 2, 2010, which is a national stage application filed under 35 USC §371 of International Application No. PCT/JP2007/061178, filed Jun. 1, 2007, the contents of which are incorporated herein by reference in their entirety.

TECHNICAL FIELD

The present invention relates to a mechanical pencil which can rotate a writing lead (refill lead) by writing pressure.

BACKGROUND ART

In the case of writing with a mechanical pencil, it is generally often the case that the mechanical pencil is not used in a situation where a body cylinder is perpendicular to a writing side (page), but used in a situation where the body cylinder is somewhat inclined to the writing side. In the case where the body cylinder is thus inclined, there arises a phenomenon that a drawn line becomes bold as compared with that in the beginning, since the writing lead may locally abrade as the writing proceeds. Further, not only the drawn line changes in boldness, but also there arises a phenomenon that the drawn line changes in thickness (drawn line becomes thin) as the writing proceeds, since a contact area of the writing lead changes with respect to the writing side.

In order to avoid the above-mentioned problem, when the writing is carried out with the body cylinder being rotated, then it is possible to avoid such a problem that, as described above, the drawn line becomes bold as it is drawn, since a sharper side of the writing lead is in contact with the page when writing. However, when you write down with the body cylinder being rotated, there arises a problem in that operation of re-holding the body cylinder is required while the writing proceeds, leading to considerable reduction in writing efficiency.

In that case, it is not impossible to write down by re-holding the body cylinder and rotating it in a stepwise manner, in the case where exterior of the body cylinder is formed to be cylindrical. However, in the case of the mechanical pencil whose exterior may not be cylindrical and which may be designed to have a projection in the middle or which is a side-knock-type mechanical pencil, it is difficult to write by re-holding the body cylinder to be rotated in a stepwise manner as described above.

In order to solve such a problem, as described above, patent documents 1 and 2 disclose that a main part of a mechanical pencil is provided with a small motor, reduction gears, etc., so that a writing lead is gradually rotated according to writing operation.

Patent Document 1: Japanese Patent Application Publication (KOKAI) No. S51-44029

Patent Document 2: Japanese Utility Model Publication (KOKOKU) S52-50828

DISCLOSURE OF THE INVENTION

Object of the Invention

Incidentally, according to the mechanical pencil disclosed in the above-mentioned patent documents 1 and 2, it is necessary for the main part of the mechanical pencil to have the small motor, the reduction gears, etc. as described above, and also the necessity arises to install a battery etc. in order to rotationally drive the small motor.

Therefore, the cost of a product unavoidably increases, and the whole mechanical pencil is large in size and increases in weight, leading to very poor user-friendliness.

The present invention arises in view of the above-mentioned problems with the mechanical pencil disclosed in patent documents, and aims at providing a light-weight mechanical pencil in which a rotational drive mechanism allowing a writing lead to be rotated using writing pressure is provided, and which does not substantially have the necessity of changing an existing exterior shape.

Means for Solving the Problems

The mechanical pencil in accordance with the present invention made in order to solve the above-mentioned problem is a mechanical pencil arranged to grasp and release a writing lead by reciprocation of a chuck provided in a body cylinder so as to inch the writing lead forward, characterized in that a rotational drive mechanism is provided which is held within the body cylinder so as to be rotatable about a lead axis in which a rotor is retreated and moved forward by writing pressure of the writing lead so as to rotationally drive the rotor, and the writing lead may be rotated by the rotational drive mechanism.

In a first preferred embodiment, the rotor which constitutes the rotational drive mechanism is formed into the shape of a ring, first and second cam faces are respectively formed at one end face and another end face of the rotor in an axial direction, and first and second fixed cam faces are arranged on the body cylinder side so as to face the first and second cam faces, respectively.

In this case, it is arranged that the first cam face in the ring-shaped rotor is brought into abutment with and meshed with the first fixed cam face by retreat operation of the writing lead by way of the writing pressure and the second cam face in the ring-shaped rotor is brought into abutment with and meshed with the second fixed cam face by releasing the writing pressure; the second cam face on the rotor side and the second fixed cam face are arranged to have a phase-shifted relationship with respect to one tooth of a cam in the axial direction in a situation where the first cam face on the rotor side is meshed with the first fixed cam face; the first cam face on the rotor side and the first fixed cam face are arranged to have the phase-shifted relationship with respect to one tooth of the cam in the axial direction in a situation where the second cam face on the rotor side is meshed with the second fixed cam face.

In addition, it is preferable that a spring member is provided which biases the second cam face in the ring-shaped rotor into abutment with the second fixed cam face and brings the second cam face and the second fixed cam face to mesh with each other in a situation where the writing pressure is released.

In a second preferred embodiment of the mechanical pencil in accordance with the present invention, first and second legs are arranged at one end face and another end face, in an axial direction, of the rotor which constitutes the rotational drive mechanism at acute angles with respect to the faces, respectively, and first and second groove formation sides are disposed on the body cylinder side and selectively engage with tips of the first and second legs; when the rotor moves to a first position in the axial direction by retreat operation of the chuck unit under the writing pressure, the first leg engages with the first groove formation side and rotationally steps the rotor in one direction; when the rotor returns to a second position in the axial direction by release of the writing pressure, the second leg engages with the second groove formation side and rotationally steps the rotor in the same direction.

In this case, it is desirable to have a spring member for biasing the rotor so as to return to the second position in the axial direction in a situation where the writing pressure is released.

Further, in the second embodiment, it is also possible to arrange the weight of the rotor including the chuck unit to cause the rotor to return to the second position in the axial direction in a situation where the writing pressure is released.

Furthermore, in a third preferred embodiment of the mechanical pencil in accordance with the present invention, the rotor which constitutes the rotational drive mechanism is formed into the shape of a ring, a cam face is formed at an end face of the rotor in an axial direction thereof, and the ring-shaped rotor moves to a first position in the axial direction by retreat operation of the chuck unit under the writing pressure, and returns to a second position in the axial direction by release of the writing pressure; a fixed abutting member arranged on the body cylinder side which comes into abutment with a slope of the cam face, and rotationally steps the rotor in one direction by movement of the ring-shaped rotor to the first position, and a movable abutting member which moves in the axial direction in the case where the ring-shaped rotor moves to the second position, while being in contact with the slope of the cam face, and rotationally steps the rotor in the same direction.

It is preferable that the fixed abutting member and the movable abutting member in the above-mentioned structure are respectively formed at tips of first and second cylindrical members which are formed cylindrically and arranged coaxially within the body cylinder, the second cylindrical member having the movable abutting member is disposed within the first cylindrical member having the fixed abutting member, and the second cylindrical member is arranged to be movable in an axial direction within the first cylindrical member by combination of grooves and ribs mutually formed in the axial direction at the first cylindrical member and second cylindrical member.

In this case, it is desirable that a spring member which returns the ring-shaped rotor to the second position is arranged to bias the second cylindrical member forward in a situation where the writing pressure is released.

Further, in the third embodiment, the movable abutting member can be arranged to be brought into abutment with the cam face of the ring-shaped rotor by weight of the second cylindrical member in a situation where the above-mentioned writing pressure is released.

In the first to the third embodiments in which the spring member for returning the position of the rotor upon release of the writing pressure is used, it is desirable that a torque canceller which is formed cylindrically is interposed between the rotor and the spring member so as to prevent the rotational motion of the rotor from being transmitted to the spring member.

Effect of the Invention

According to the mechanical pencil having the above-described structure, there are advantages in that the rotational drive mechanism is provided in which the chuck unit is retreated under the writing pressure of the writing lead so as to rotationally drive the rotor. According to the first preferred embodiment, with application of the writing pressure, the rotor moves in the axial direction, and is subjected to rotational motion when the first cam face of the rotor is brought to mesh with the first fixed cam face. Further, as the writing pressure is released, the rotor returns to the original position, and then operates so as to bring the second cam face of the rotor to mesh with the second fixed cam face so as to be subjected to the rotational motion in the same direction.

Therefore, when the rotor is reciprocated in the axial direction by writing, the rotor is subjected to the rotational motion corresponding to one tooth of the cam. By repeating this operation, the writing lead is rotationally driven stepwise. Thus, it is possible to provide the rotational drive mechanism having a simple structure, in which the writing lead can be rotated by writing.

Further, according to the above-mentioned second embodiment, with application of the writing pressure, the rotor moves in the axial direction, and the first leg attached to the rotor engages with the first groove formation side arranged at the body cylinder side, so as to rotationally step the rotor in one direction. Further, when the writing pressure is released, the rotor returns to the original position, and the second leg attached to the rotor engages with the second groove formation side arranged at the body cylinder side, so as to rotationally step the rotor in the same direction.

Therefore, when the rotor is reciprocated in the axial direction by writing, the rotor is subjected to the rotational motion corresponding to bending of the leg. By repeating this operation, the writing lead is rotationally driven stepwise. Thus, it is possible to provide another rotational drive mechanism having a simple structure, in which the writing lead can be rotated with writing.

Furthermore, according to the above-mentioned third embodiment, with application of the writing pressure, the rotor moves in the axial direction, so that the fixed abutting member provided on the body cylinder side comes into abutment with the cam face formed at the rotor, so as to rotationally step the rotor in one direction. Further, when the writing pressure is released, the movable abutting member slides in the axial direction in contact with the cam face of the rotor, so as to rotationally step the rotor in the same direction.

Therefore, when the rotor is reciprocated in the axial direction by writing, the rotor is subjected to the rotational motion by the action of the fixed abutting member which abuts a cam face thereof and the movable abutting member. By repeating this operation, the writing lead is rotationally driven stepwise. Thus, it is possible to provide another rotational drive mechanism having the simple structure in which the writing lead can be rotated with writing.

According to the mechanical pencil of the above-mentioned first to third embodiments, with application of the writing pressure, the writing lead can be rotated in any of the embodiments, so that local abrasion of the writing lead can be controlled effectively even in the mechanical pencils which may be designed to have a projection in the middle of the body cylinder as described above or which may be difficult to write by re-holding and rotating the body cylinder of a "side-knock-type" mechanical pencil. Thus, it is possible to prevent the local abrasion of the writing lead according to the progress of the writing and to solve the problem that the thickness of a drawn line and the boldness of the drawn line may change badly.

BRIEF DESCRIPTION OF THE DRAWINGS

FIG. 1 is a perspective view showing a first embodiment of a mechanical pencil in accordance with the present invention, which is partially seen through.

FIG. 5 is a perspective view showing a second embodiment of the mechanical pencil in accordance with the present invention, which is partially seen through.

FIG. 8 is a perspective view showing a third embodiment of the mechanical pencil in accordance with the present invention, which is partially seen through.

DESCRIPTION OF REFERENCE NUMERALS AND SIGNS

Figure 1:
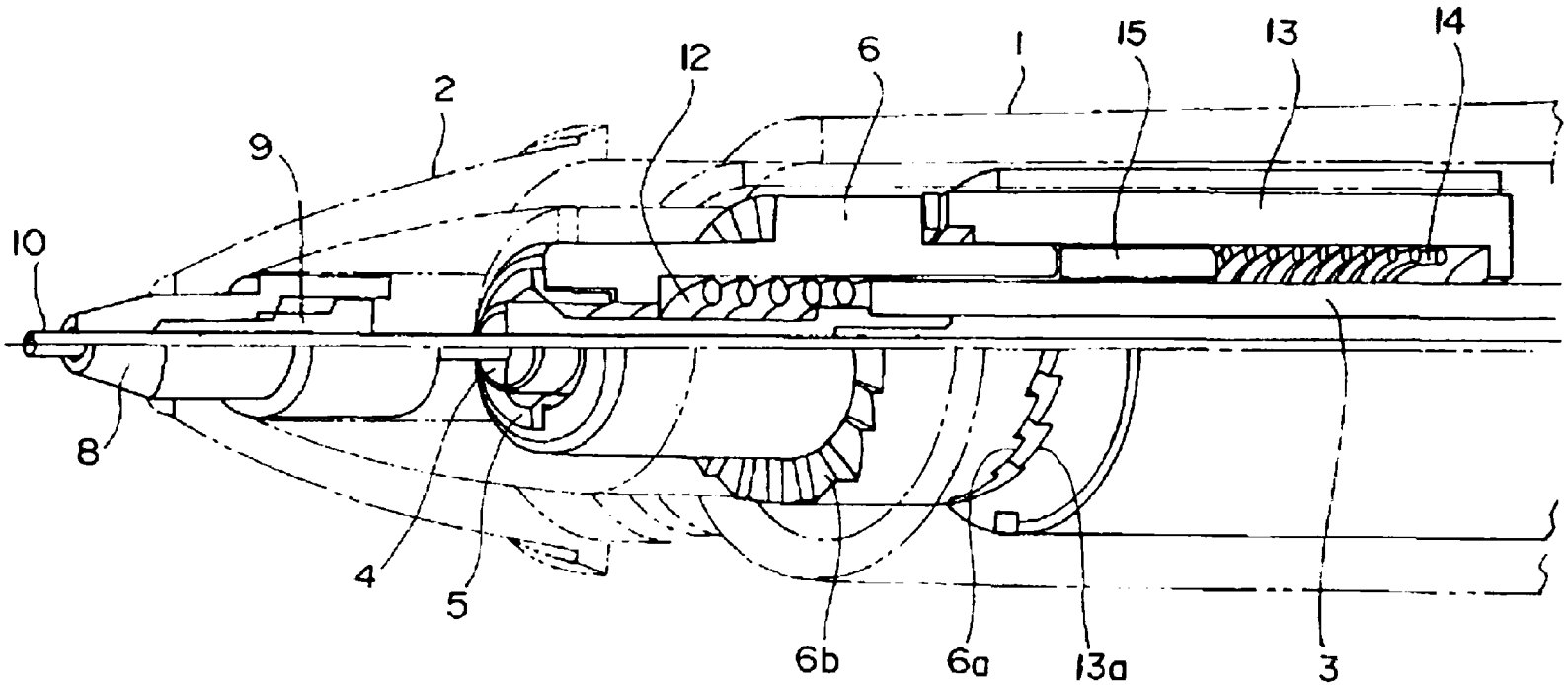

1: body cylinder
2: plastic base
3: lead case
4: chuck unit
5: clamp
6, 21, 31: rotors
6*a*: first cam face
6*b*: second cam face
10: writing lead
12: return spring
13: upper cam formation member
13*a*: first fixed cam face
14, 25, 34: spring members
15, 24, 33: torque canceller
17: lower cam formation member
17*a*: second fixed cam face
21*a*: first leg
21*b*: second leg
22*a*: first groove formation side
23*a*: second groove formation side
31*a*: cam face
32: first cylindrical member
32*a*: fixed abutting member
32*b*: groove
33: second cylindrical member
33*a*: movable abutting member
33*b*: rib

BEST MODE FOR CARRYING OUT THE INVENTION

Hereinafter, a mechanical pencil in accordance with the present invention will be described with reference to the embodiments illustrated in the drawings. Firstly, FIGS. 1-3 show a first preferred embodiment. FIG. 1 shows a principal part of a mechanical pencil which is partly broken, and partially seen through. Reference numeral 1 denotes a body cylinder which constitutes the exterior, and reference numeral 2 indicates a base attached to a tip portion of the body cylinder 1, i.e., a plastic base molded conically with a resin.

A cylindrical lead case 3 is accommodated coaxially within the body cylinder 1, and a chuck unit 4 is connected with a tip portion of the lead case 3. The chuck unit 4 is mounted so that its tip portion may be in a loose fit state in an annular clamp 5, and the clamp 5 is attached to a ring-shaped tip portion of a rotor 6.

The mechanical pencil shown in FIG. 1 is arranged to have a so-called pipe slide structure where a slider 8 is accommodated in the tip portion of the plastic base 2, and a holding chuck 9 made of rubber is accommodated in the slider 8. Further, a linear lead inserting hole is so formed as to pass through the inside of the slider 8 via the chuck unit 4 from the above-mentioned lead case 3, and a writing lead (refill lead) 10 is inserted into the inserting hole.

In the mechanical pencil shown in FIG. 1, when knock operation of a knock part (not shown) which is disposed at a rear end portion of the body cylinder 1 is carried out, the lead case 3 advances in the body cylinder 1. The tip of the chuck unit 4 projects from the clamp 5 to cancel a grasp state of the writing lead 10. With cancellation of the knock operation, the lead case 3 and the chuck unit 4 retreat in the body cylinder 1 by the action of a return spring 12, and the tip portion of the chuck unit 4 is accommodated in the clamp 5, thus the writing lead 10 again comes into the grasp state. In other words, the writing lead 10 is grasped and released when the chuck unit 4 moves back and forth by repeating the knock operation, whereby the writing lead 10 operates to inch forward from the chuck unit 4 stepwise.

The rotor 6 shown in FIG. 1 is formed into a ring shape where a central part in the axial direction is larger in diameter. A first cam face 6*a* is formed at one end face (rear end face), and a second cam face 6*b* is formed at the other end face (front end face) which is formed into a ring shape. On the other hand, at the rear end of the rotor 6, a cylindrical upper cam formation member 13 is mounted in the body cylinder 1 so as to cover the rear end of the rotor 6. At the front end of the upper cam formation member 13, a fixed cam face (also referred to as "first fixed cam face") 13*a* is formed so as to face the first cam face 6*a* in the rotor 6.

Furthermore, although not shown in FIG. 1, a cylindrical lower cam formation member is mounted on the body cylinder 1 side so as to face the second cam face 6*b* in the rotor 6, and a fixed cam face (also referred to as "second fixed cam face") is formed at the rear end in the axial direction. In addition, a relationship and mutual operation among the first and the second cam faces 6*a* and 6*b* which are formed at the rotor 6, the first fixed cam face 13*a*, and the second fixed cam face will be described in detail later with reference to FIGS. 2 and 3.

Further, a coil-like spring member 14 is mounted in the upper cam formation member 13. The spring member 14 acts so as to bias forward a torque canceller 15 which is formed cylindrically and movable in the axial direction. Being pushed by the torque canceller 15 subjected to this bias force, the rotor 6 moves forward.

According to the above-mentioned structure, in a situation where the chuck unit 4 grasps the writing lead 10, the rotor 6 together with the chuck unit 4 is accommodated in the body cylinder 1 so as to be rotatable about a lead axis. Further, in a situation where the mechanical pencil is not in use (or not in writing state), the rotor 6 is biased forward by the action of the spring member 14 through the torque canceller 15, resulting in a situation shown in FIG. 1.

On the other hand, when the mechanical pencil is used, i.e., when the writing pressure is applied to the writing lead 10, the chuck unit 4 retreats against the bias force of the spring member 14. According to this operation, the rotor 6 also retreats in the axial direction. Therefore, the first cam face 6*a* formed at the rotor 6 shown in FIG. 1 engages with and meshes with the first fixed cam face 13*a*.

FIGS. 2(A) to 2(C) and FIGS. 3(D) and 3(E) are for explaining in order the operation of a rotational drive mechanism which rotationally drives the rotor 6 by the above-mentioned operation. In FIGS. 2 and 3, reference numeral 6 indicates the above-mentioned rotor which is schematically shown, and at one end face thereof (upper face in figures) the first cam face 6*a* having a continuous sawtooth shape along a circumference direction is formed into the shape of a ring. Further, similarly, the second cam face 6*b* having a continuous sawtooth shape along the circumference direction is formed into the shape of a ring at the other end face (lower face in figures) of the rotor 6.

On the other hand, as shown in FIGS. 2 and 3, the first fixed cam face 13*a* having a continuous sawtooth shape along the circumference direction is also formed at a ring-shaped end face of the upper cam formation member 13, and a second fixed cam face 17*a* having a continuous sawtooth shape along the circumference direction is also formed at a ring-shaped end face of the lower cam formation member 17. The cam faces formed into the sawtooth shape along the circumference direction at the first cam face 6*a* and the second cam face 6*b* formed at the rotor, the first fixed cam face 13*a* formed at the upper cam formation member 13, and the second fixed cam face 17*a* formed at the lower cam formation member 17 are each arranged to have substantially the same pitch.

Figure 2A:
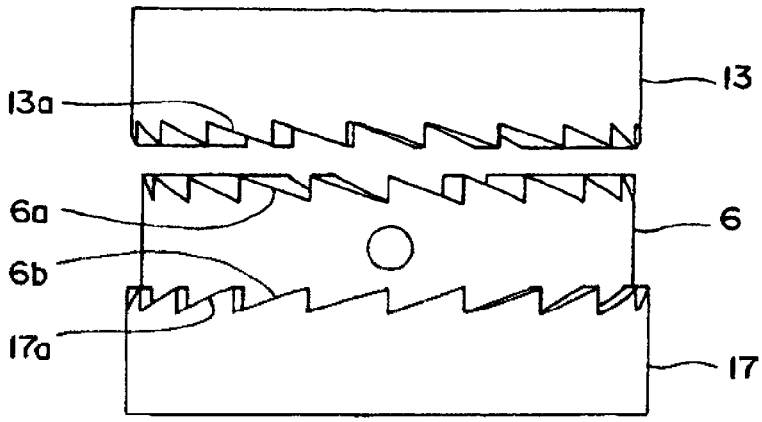
FIGS. 2(A), 2(B) and 2(C) are schematic views for explaining, in order, rotational drive actions of a rotor employed in the embodiment as shown in FIG. 1.

FIG. 2(A) shows a relationship among the upper cam formation member 13, the rotor 6, and the lower cam formation member 17 in the situation where the mechanical pencil is not in use (or not in writing state). In this situation, by the bias force of the spring member 14 shown in FIG. 1, the second cam face 6*b* formed in the rotor 6 is brought into abutment with the second fixed cam face 17*a* side of the lower cam formation member 17 mounted at the body cylinder 1. At this time, the first cam face 6*a* on the rotor 6 side and the first fixed cam face 13*a* are arranged to have a half-phase (half-pitch) shifted relationship with respect to one tooth of the cam in the axial direction.

Figure 2B:
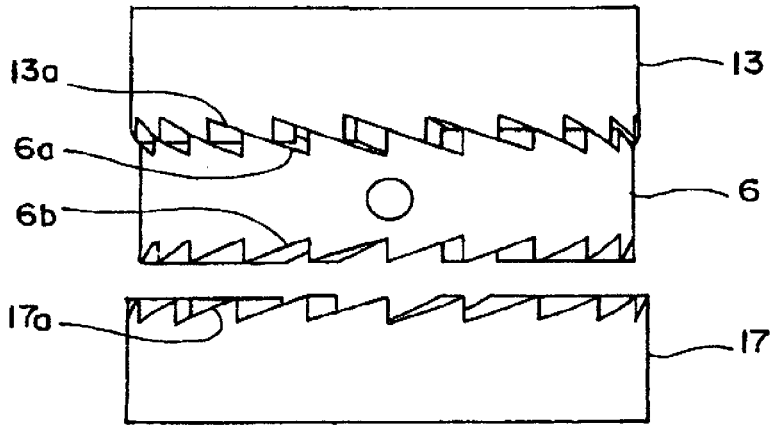

FIG. 2(B) shows an initial situation where the writing pressure is applied to the writing lead 10 by use of the mechanical pencil. In this case, as described above, the rotor 6 retreats in the axial direction while the chuck unit 4 retreats. Thus, the rotor 6 moves to the upper cam formation member 13 side mounted at the body cylinder 1.

Figure 2C:
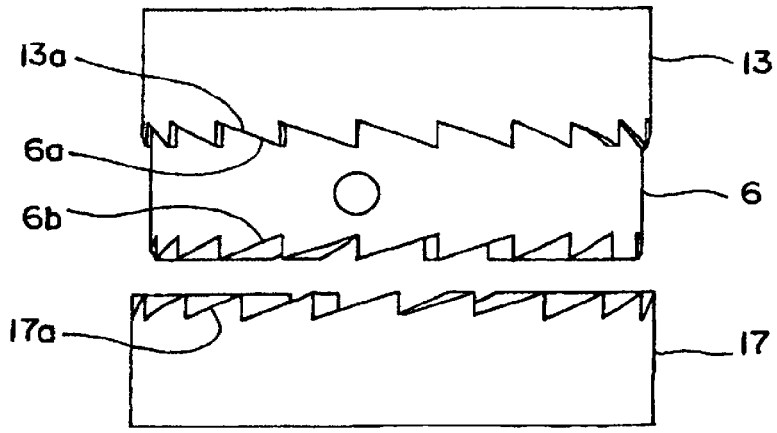

FIG. 2(C) shows a situation where the writing pressure is applied to the writing lead 10 by use of the mechanical pencil and the rotor 6 comes into abutment with the upper cam formation member 13 side and retreats further. In this case, the first cam face 6*a* formed at the rotor 6 meshes with the first fixed cam face 13*a* on the upper cam formation member 13 side. Thus, the rotor 6 is subjected to rotational drive corresponding to the half-phase (half-pitch) with respect to one tooth of the first cam face 6*a*.

In addition, circle (○) drawn in the center of the rotor 6 in FIGS. 2 and 3 indicates the amount of rotational movement of the rotor 6. In the situation shown in FIG. 2(C), the second cam face 6*b* on the rotor 6 side and the second fixed cam face 17*a* are arranged to have a half-phase (half-pitch) shifted relationship with respect to one tooth of the cam in the axial direction.

Figure 3D:
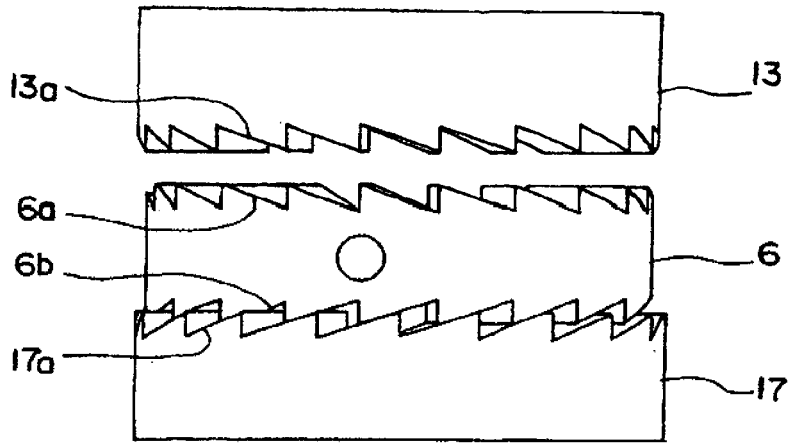
FIG. 3(D) and 3(E) are schematic views for explaining the rotational drive actions of the rotor following FIG. 2.

Next, FIG. 3(D) shows an initial situation where drawing with the mechanical pencil is finished and the writing pressure to the writing lead 10 is released. In this case, the rotor 6 moves forward in the axial direction by action of the spring member 14. Thus, the rotor 6 moves to the lower cam formation member 17 (side) mounted at the body cylinder 1.

Figure 3E:
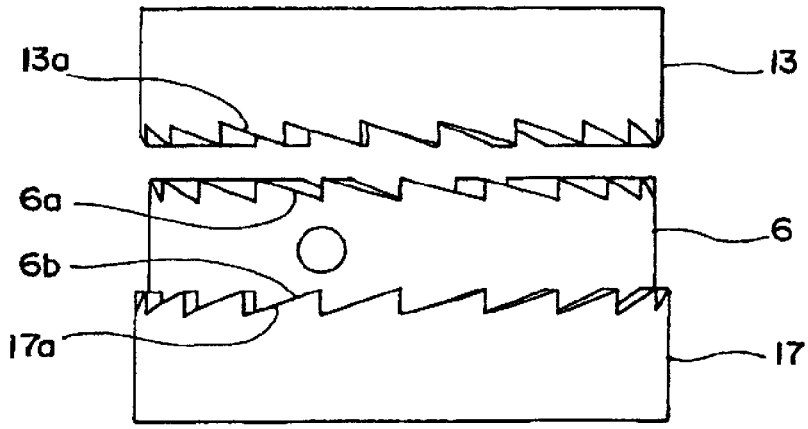

Furthermore, FIG. 3(E) shows a situation where the rotor 6 comes into abutment with the lower cam formation member 17 side and moves forward further by action of the spring member 14. In this case, the second cam face 6*b* formed at the rotor 6 meshes with the second fixed cam face 17*a* on the lower cam formation member 17 side. Thus, the rotor 6 is subjected again to the rotational drive corresponding to the half-phase (half-pitch) of one tooth of the second cam face 6*b*.

Therefore, as shown by circle (○) drawn in the center of the rotor 6, according to reciprocating movement of the rotor 6 in the axial direction, the rotor 6 is subjected to the rotational drive corresponding to one tooth (one pitch) of the first and second cam faces 6*a* and 6*b*, and the writing lead 10 grasped by the chuck unit 4 is rotationally driven through the chuck unit 4 similarly.

As is clear from the above description, according to the mechanical pencil having the structure as illustrated in FIGS. 1 to 3, each time the writing causes the rotor 6 to reciprocate in the axial direction, the rotor is subjected to the rotational motion corresponding to one tooth of the cam. By repeating this operation, the writing lead 10 is rotationally driven stepwise. Therefore, it is possible to prevent the writing lead from locally abrading as the writing proceeds, and it is also possible to solve the problem that the boldness of the drawn line and the thickness of the drawn line may change badly.

In addition, the cylindrical torque canceller 15 disposed between the rotor 6 and the coil-like spring member 14 generates a slide between the end face of the torque canceller 15 and the end face of the rotor 6, and acts so that the rotational motion of the rotor 6 generated by repetition of the writing action is prevented from being transmitted to the spring member 14.

In other words, since the torque canceller formed cylindrically is interposed between the rotor and the spring member, the rotational motion of the rotor is prevented from being transmitted to the spring member, and it is possible to solve the problem that back torsion (spring torque) of the spring member 14 occurs and places an obstacle to rotation operation of the rotor 6.

In the first embodiment as described above, as for the first cam face 6*a*, the second cam face 6*b*, the first fixed cam face 13*a*, and the second fixed cam face 17*a*, the cam faces are arranged to have the continuous sawtooth shape in the circumferential direction, however the rotational drive mechanism for rotating the writing lead is not limited to such a specific arrangement.

Figure 4A:
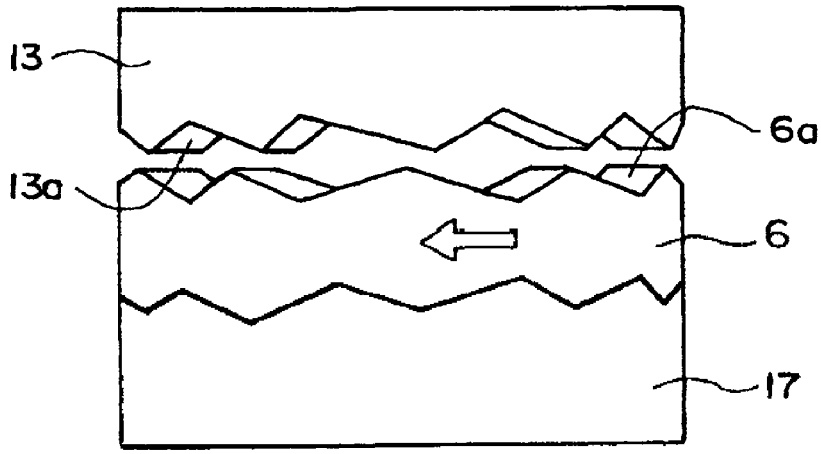
FIG. 4(A) and 4(B) are schematic views for explaining another rotational drive mechanism for the rotor, which can be employed in the embodiment as shown in FIG. 1.
Figure 4B:
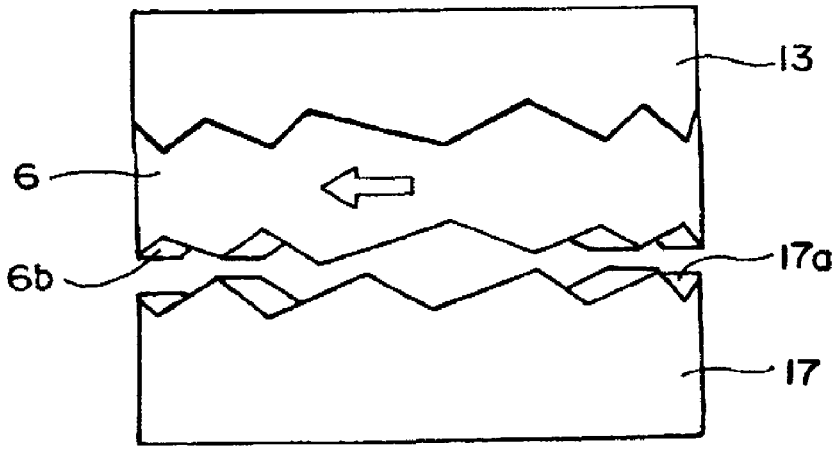

FIG. 4 schematically shows another example of the above-mentioned rotational drive mechanism. FIG. 4(A) shows a state similar to the operation state as already described and shown in FIG. 2(A), and FIG. 4(B) shows a state similar to the operating state as shown in FIG. 2(C). Further, in FIG. 4, like reference signs indicate like parts which achieve like functions as shown in FIG. 2.

As shown in FIG. 4, the first cam face 6*a* in which there are continuous undulations whose upslopes and downslopes have substantially the same inclination to the axial direction is formed into the shape of a ring at one end face (upper face in figure) of the rotor 6. Further, the second cam face 6*b* in which there are continuous undulations similarly is also formed in the shape of a ring at the other end face (lower face in figure).

Further, the cam faces in which there are continuous undulations whose upslopes and downslopes have substantially the same inclination to the axial direction are also formed at the first fixed cam face 13*a* formed at the end face of the upper cam formation member 13 facing the first cam face 6*a*, and at the second fixed cam face 17*a* formed at the end face of the lower cam formation member 17.

Except in the case where the mechanical pencil is in the writing state, as shown in FIG. 4(A), the bias force of the spring member 14 brings the rotor 6 into abutment with the second fixed cam face 17*a* side formed at the end face of the lower cam formation member 17 mounted at the body cylinder 1 side. Therefore, the second cam face 6*b* of the rotor 6 engages with and meshes with the second fixed cam face 17*a*. At this time, the first cam face 6*a* on the rotor side and the first fixed cam face 13*a* are arranged to have the half-phase shifted relationship with respect to one tooth of the cam in the axial direction.

On the other hand, in the case where the mechanical pencil is used, that is, in the case of the writing state, the rotor 6 retreats in the axial direction as described above. As shown in FIG. 4(B), the rotor 6 moves towards and meshes with the first fixed cam face 13*a* side formed at the upper cam formation member 13 mounted on the body cylinder 1 side. At this time, therefore, the rotor 6 is rotationally driven by an angle corresponding to the half-phase of one tooth formed at the cam.

As shown in FIG. 4(B), in the situation where the first cam face 6*a* is brought to mesh with the first fixed cam face 13*a*, the second cam face 6*b* on the rotor 6 side and the above-mentioned second fixed cam face 17*a* are arranged to have the half-phase shifted relationship with respect to one tooth of the cam in the axial direction. At this time, therefore, it returns to the state as shown in FIG. 4(A) in the case where the writing pressure is released, and the rotor 6 is again rotationally driven by an angle corresponding to the half-phase of one tooth formed at the cam.

In other words, also in the rotational drive mechanism with the structure shown in FIG. 4, it is possible to obtain the operational effect similar to that of the rotational drive mechanism shown in FIGS. 2 and 3.

Further, in the embodiment described above, the spring member 14 shown in FIG. 1 is used. In the case where the writing pressure is released, it is arranged that the bias force of the spring member 14 causes the rotor 6 to return to the state before application of the writing pressure and to apply the rotational motion to the rotor. Thus, in the case where the spring member 14 is used, the rotation operation of the rotor is stabilized, which is preferred. However, the return action of the rotor 6 in the case of the released writing pressure can be carried out by the weight of the rotor 6 including the above-mentioned chuck unit, without using the spring member 14. Thus, in the case of using gravity, it is possible to contribute to simplifying the mechanism and reduction in cost.

Figure 5:
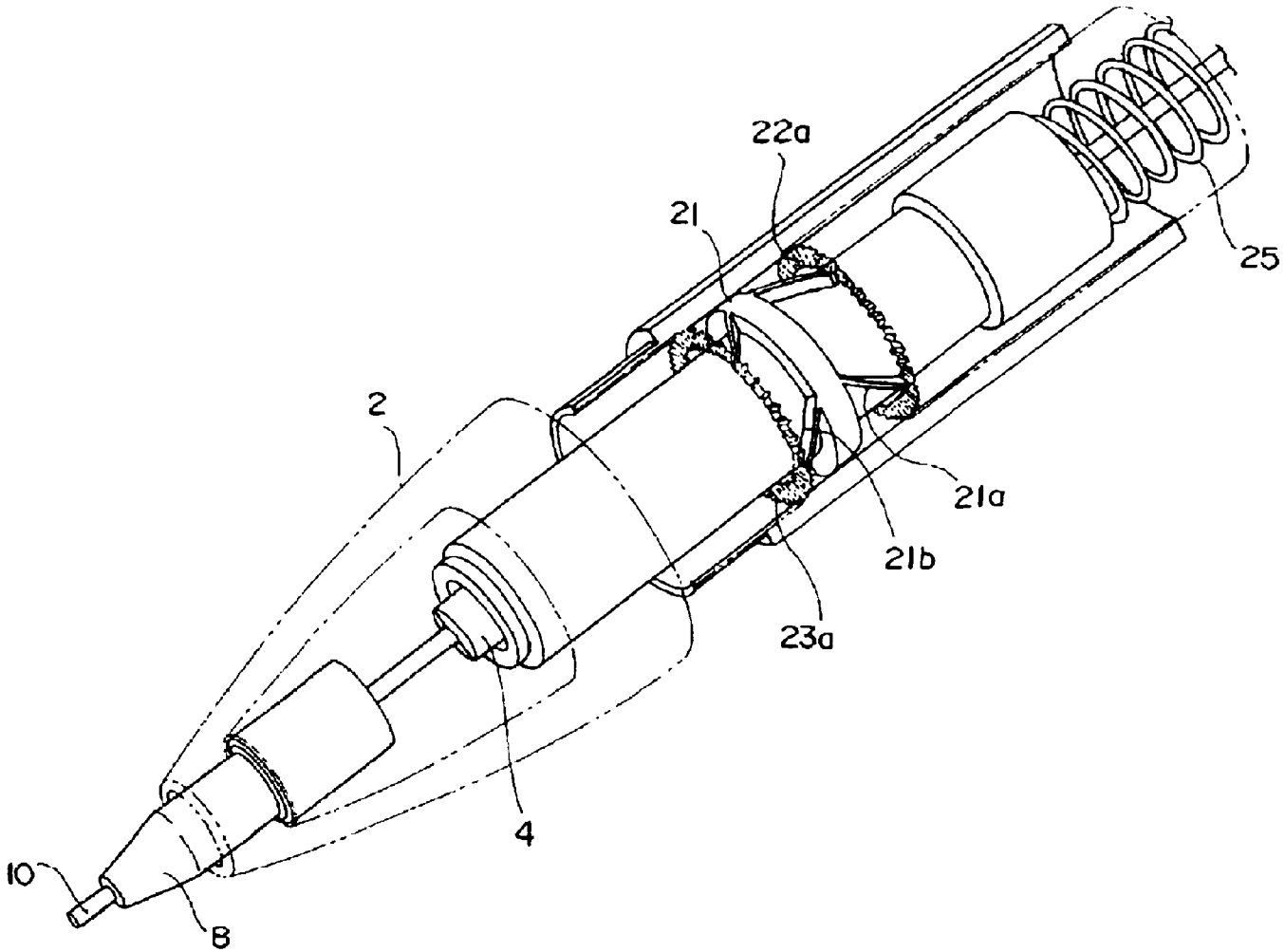
Figure 6:
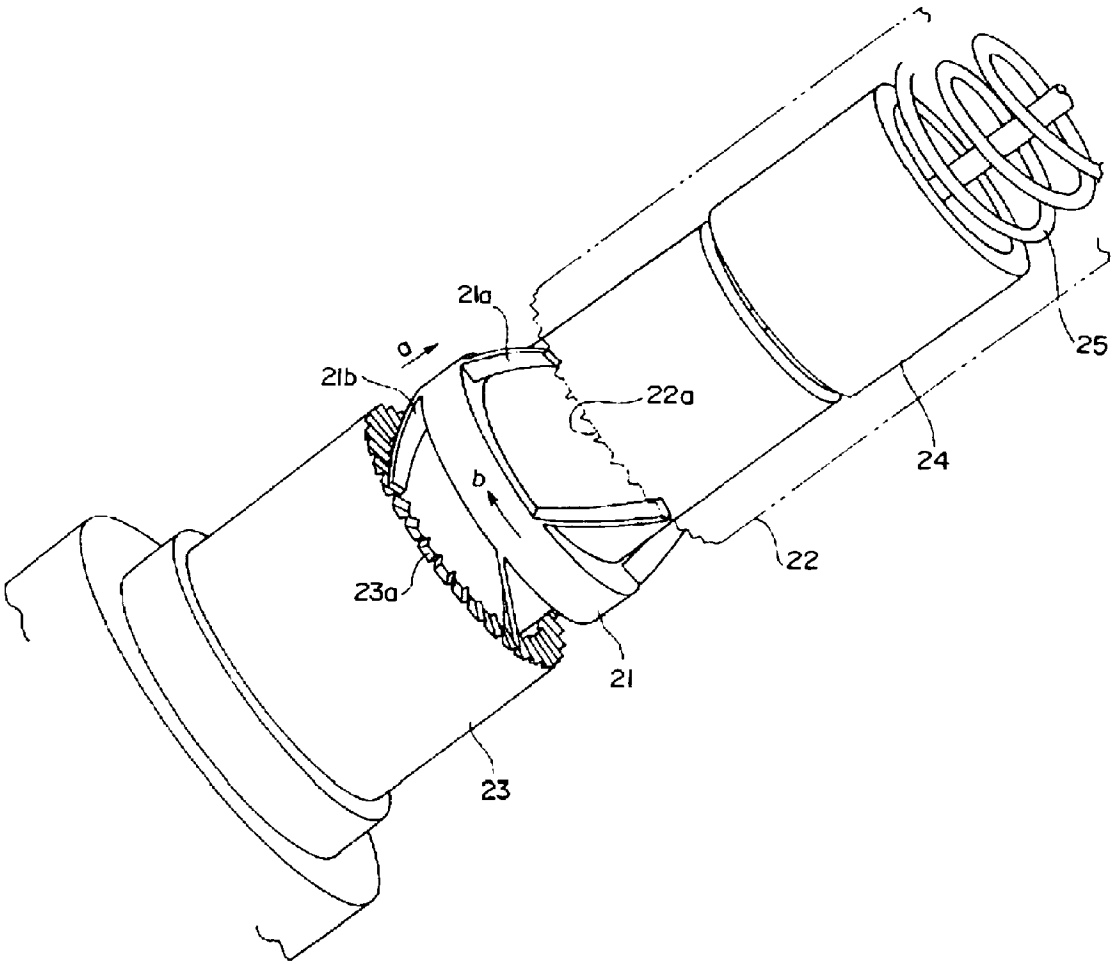
FIG. 6 is a fragmentary perspective view for explaining a rotational drive mechanism for the rotor employed in the embodiment as shown in FIG. 5.
Figure 7:
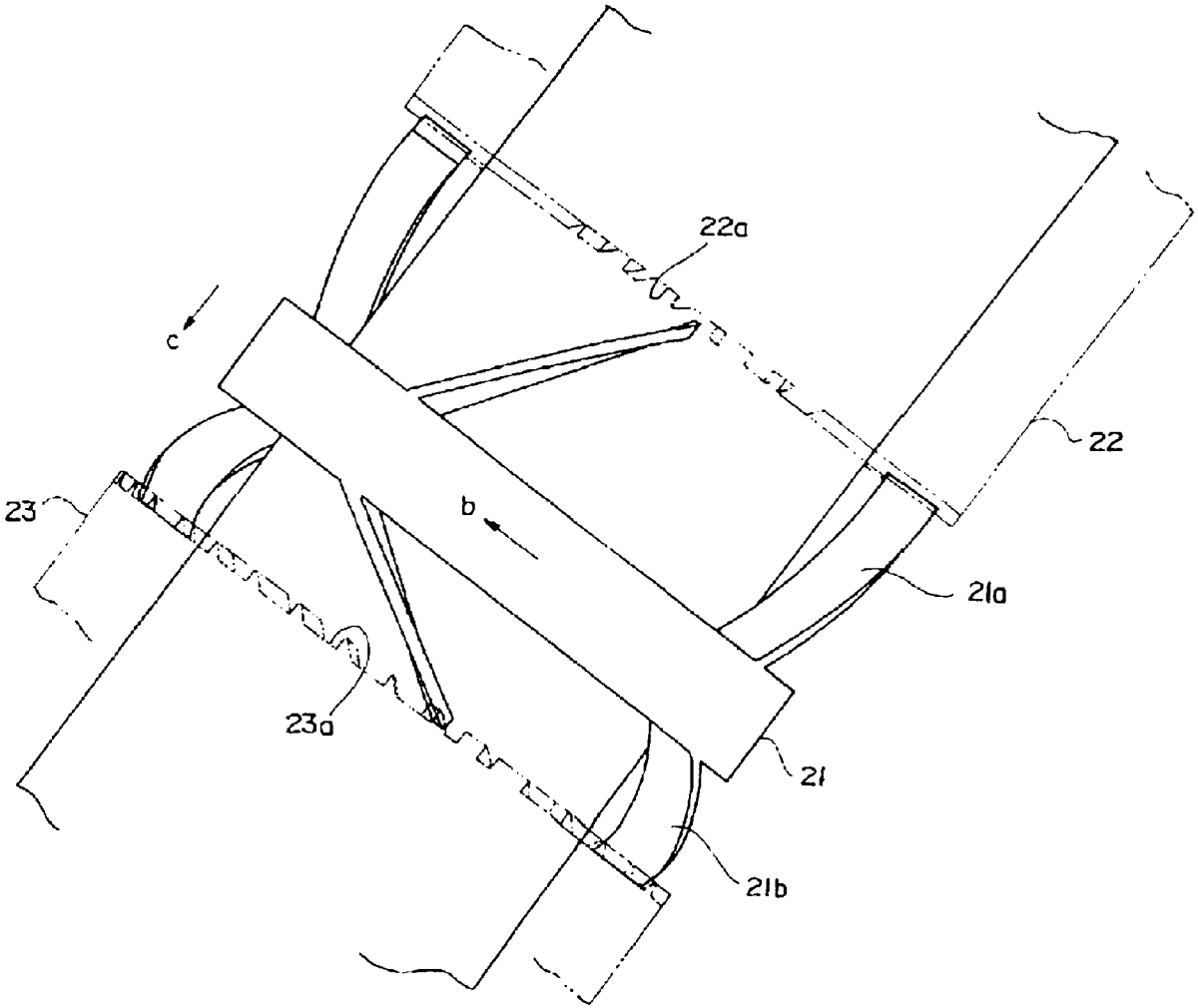
FIG. 7 is a fragmentary perspective view in which the principal part of the rotational drive mechanism employed in the embodiment similarly shown in FIG. 5 is further expanded and shown.

FIGS. 5-7 show a second embodiment of the mechanical pencil in accordance with the present invention. In addition, FIG. 5 shows the principal part of the second embodiment which is partially seen through, where like reference signs indicate like parts equivalent to the respective parts in the embodiment shown in FIG. 1. Further, a basic structure for realizing the inching operation of the writing lead in the mechanical pencil etc., is similar to that shown in FIG. 1, therefore its description will not be repeated.

Also in this second embodiment, the rotor 21 formed in the shape of a ring is provided. This rotor 21 together with the chuck unit 4 is disposed in the body cylinder (not shown) so as to be rotatable about the lead axis and movable in the axial direction. The first and second legs 21*a* and 21*b* are disposed on one end face and the other end face of the rotor 21 in the axial direction and at acute angles to the above-mentioned faces, respectively. In addition, a plurality of the first legs 21*a* are molded at substantially regular intervals along one annular end face at the rotor 21, and a plurality of the second legs 21*b* are similarly molded at substantially regular intervals along the other annular end face at the rotor 21.

As illustrated in FIGS. 6 and 7 in detail, an end face of a cylinder body 22 is located facing the tip of the first leg 21*a*, and this end face constitutes a first groove formation side 22*a*. Further, an end face of a cylinder body 23 is located facing the tip of the above-mentioned second leg 21*b*, and this end face constitutes a second groove formation side 23*a*. In addition, sawtooth-like projections are radially formed at the first and second groove formation sides 22*a* and 23*a* along the circumferential direction. Further, the cylinder bodies 22 and 23 are mounted on the body cylinder side (not shown).

On the other hand, a coil-like spring member 25 is provided that biases forward the rotor 21 and the chuck unit 4 which move integrally. In the case where the pressure by the writing is applied, the chuck unit 4 retreats against the bias force of the spring member 25. With this operation, the rotor 21 operates to retreat in the axial direction. In addition, the cylindrical lead case is disposed inside the spring member 25, which is not shown.

In the above-mentioned structure, when the mechanical pencil is used or when the writing pressure is applied, the chuck unit 4 retreats against the bias force of the spring member 25. With this operation, the rotor 21 also retreats in the axial direction. In other words, as shown in FIG. 6, since the rotor 21 moves in a direction of arrow a (moves to first position), the first leg 21*a* engages with the first groove formation side 22*a* and bends, so as to rotationally step the rotor 21 in a direction of arrow b.

Further, in the case where the writing pressure is released, the chuck unit 4 and the rotor 21 are returned in a direction of arrow c (moves to second position) as shown in FIG. 7 by the action of the spring member 25. Thus, the second leg 21*b* engages with the second groove formation side 23*a* and bends, so as to rotationally step the rotor 21 in the direction of arrow b.

Therefore, when the rotor 21 is reciprocated in the axial direction by the writing, the rotor 21 is subjected to the rotational motion corresponding to the bending of the leg. By repeating this operation, the writing lead 10 is rotationally driven stepwise. Therefore, it is possible to prevent the writing lead from locally abrading as the writing proceeds, and also possible to obtain the operational effect similar to that in the first embodiment as already described.

In addition, also in the above-mentioned second embodiment, a cylindrical torque canceller denoted by reference numeral 24 in FIG. 6 is provided. Since the torque canceller 24 is interposed between the rotor 21 and the spring member 25, the rotational motion of the rotor 21 is prevented from being transmitted to the spring member 25, thereby making it possible to solve the problem that the back torsion (spring torque) of the spring member 25 occurs and places the obstacle to rotation operation of the rotor 21.

Further, also in the above-mentioned second embodiment, the spring member 25 shown in FIGS. 5 and 6 is used. In the case where the writing pressure is released, it is arranged such that the bias force of the spring member 25 causes the rotor 21 to return to the state before application of the writing pressure and to apply the rotational motion to the rotor. Thus, in the case where the spring member 25 is used, the rotation operation of the rotor is stabilized, which is preferred. However, the return action of the rotor 21 in the case of the released writing pressure may be carried out by the weight of the rotor 21 including the above-mentioned chuck unit, without using the spring member 25. Thus, in the case of using gravity, it is possible to contribute to simplifying the mechanism and reduction in cost.

Figure 8:
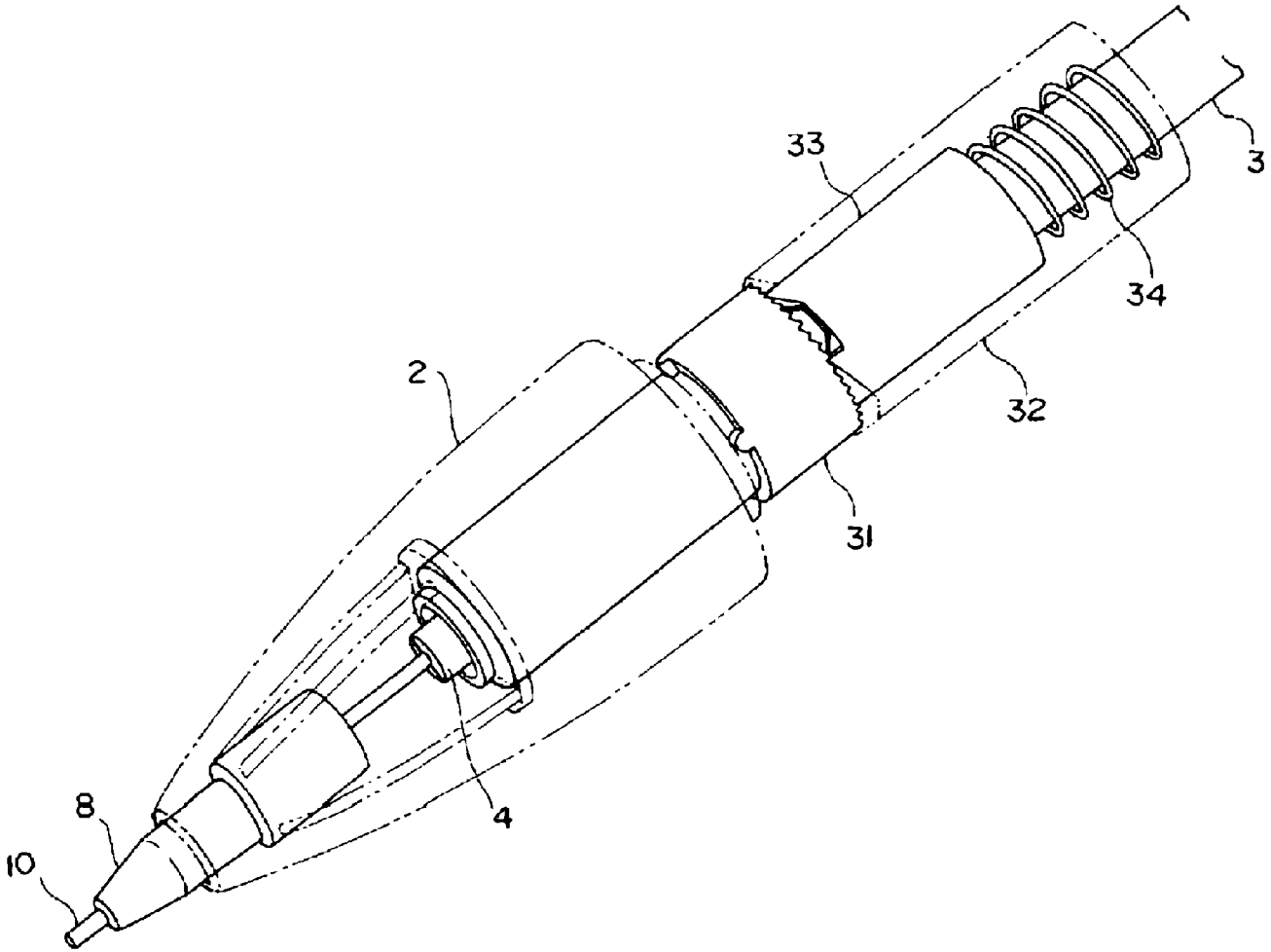

FIGS. 8-15 show a third embodiment of the mechanical pencil in accordance with the present invention. In addition, FIG. 8 shows the principal part of the third embodiment which is partially seen through, where like reference signs indicate like parts equivalent to the respective parts in the embodiment shown in FIG. 1. Further, a basic structure for realizing the inching operation of the writing lead in the mechanical pencil etc., is similar to that shown in FIG. 1, therefore its description will not be repeated.

Figure 9:
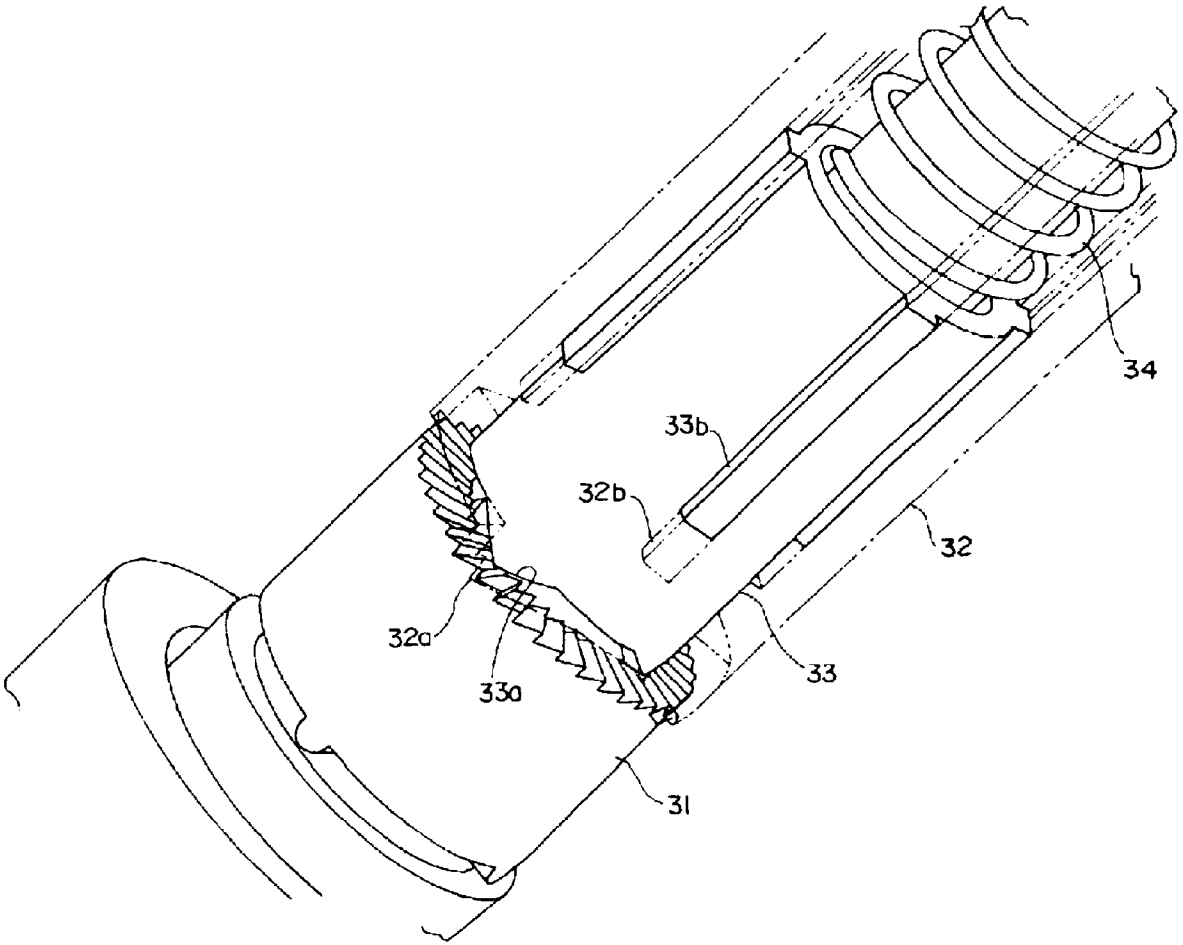
FIG. 9 is a fragmentary perspective view for explaining the rotational drive mechanism for the rotor employed in the embodiment as shown in FIG. 8.
Figure 10:
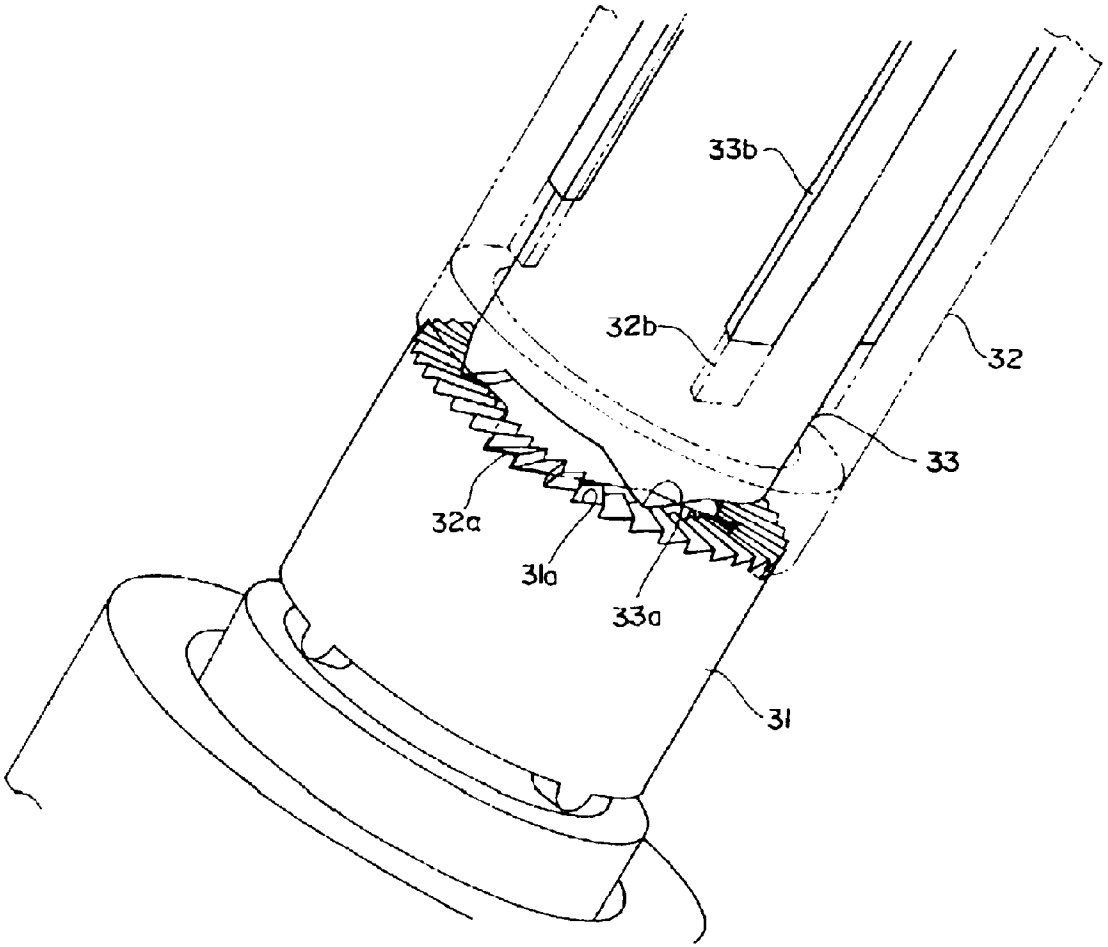
FIG. 10 is a fragmentary perspective view in which the principal part of the rotational drive mechanism employed in the embodiment similarly shown in FIG. 8 is further expanded and shown.

Also in this third embodiment, as shown in FIG. 8, the rotor 31 formed in the shape of a ring is provided. This rotor 31 together with the chuck unit 4 is disposed in the body cylinder (not shown) so as to be rotatable about the lead axis and movable in the axial direction. As shown in FIG. 9 and FIG. 10 in which the rotor 31 and its circumference portion are enlarged and shown, sawtooth-like protrusions are formed radially and continuously at the rear end of the rotor 31 in the axial direction, to thereby form a cam face 31*a*.

On the other hand, the first cylindrical member 32 is mounted inside the body cylinder (not shown). As shown in FIGS. 9 and 10, a fixed abutting member 32*a* constituted by two sawtooth-like protrusions is formed at a front end of the cylindrical member 32 so as to face the cam face 31*a* of the rotor 31. In addition, the fixed abutting member 32*a* is enlarged and indicated by solid lines in FIG. 11 et seq. as will be described later. Further, a plurality of the fixed abutting members 32*a* are formed at the front end of the cylindrical member 32 at substantially regular intervals in the circumference direction.

The second cylindrical member 33 is accommodated coaxially inside the first cylindrical member 32. The second cylindrical member 33 is arranged to be slidable in the axial direction inside the first cylindrical member 32. In other words, as shown in FIGS. 9 and 10, it is arranged that a plurality of grooves 32*b* are formed in the axial direction on an inner wall surface of the first cylindrical member 32, a plurality of ribs 33*b* are formed in the axial direction on an outer wall surface of the second cylindrical member 33, and each rib 33*b* is inserted into a respective one of the grooves 32*b*, whereby the second cylindrical member 33 can slide in the axial direction inside the first cylindrical member 32.

Isosceles triangle-like movable abutting members 33*a* are formed at the front end of the second cylindrical member 33 so as to face the cam face 31*a* of the rotor 31. In addition, at the front end of the cylindrical member 33, a plurality of the movable abutting members 33*a* are formed at substantially regular intervals in the circumferential direction. The second cylindrical member 33 is arranged to be subjected to the bias force so as to be pushed out forward by the coil-like spring member 34 disposed at the rear end in the axial direction as shown in FIGS. 8 and 9. Thus, the movable abutting member 33*a* formed at the second cylindrical member 33 is always in abutment with the cam face 31*a* of the rotor 31 and acts so as to bias the rotor 31 forward.

FIGS. 11-15 are for explaining in order how the cam face 31*a* formed at the rotor 31 is rotationally driven by the fixed abutting member 32*a* and the movable abutting member 33*a* due to the reciprocation of the rotor 31 in the axial direction according to the writing.

Figure 11:
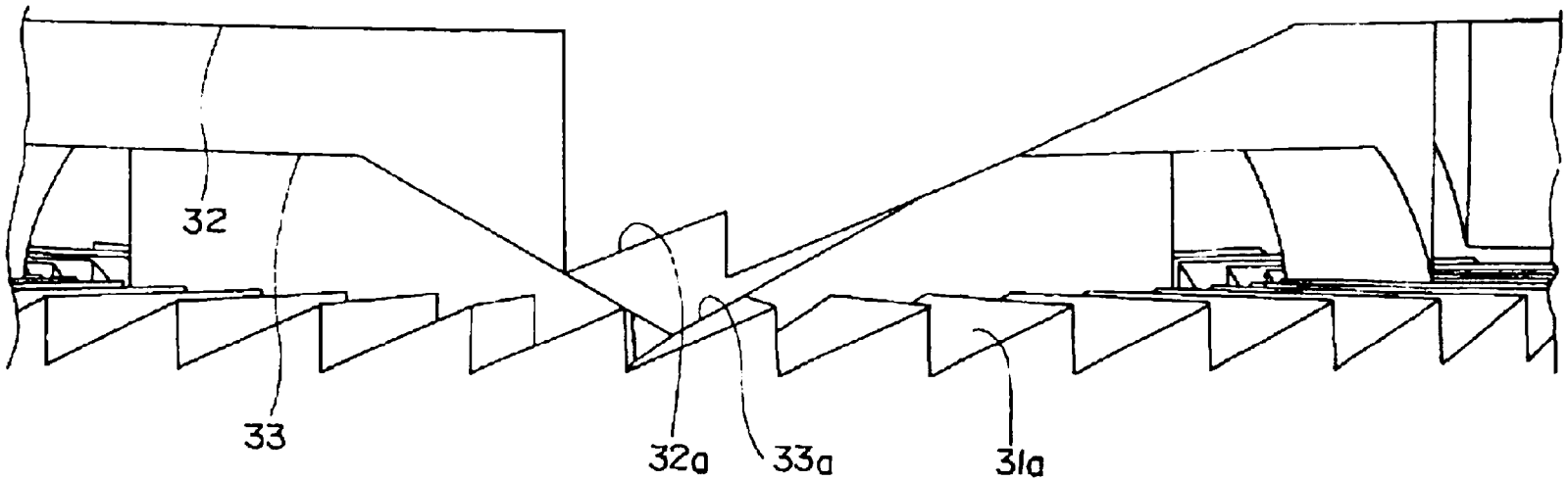
FIG. 11 is a partially enlarged view showing a situation where writing pressure is not applied in the rotational drive mechanism employed in the embodiment shown in FIG. 8.
Figure 12:
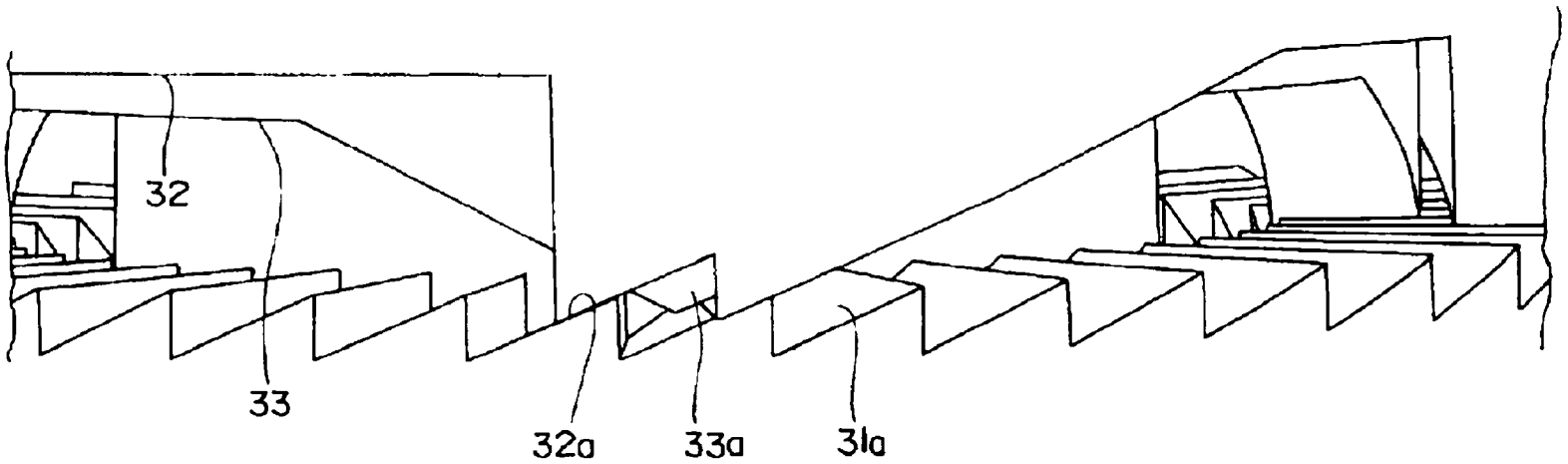
FIG. 12 is a partially enlarged view similarly showing a situation in the middle of operation in the case where the writing pressure is applied.

First, FIG. 11 shows a situation where the writing pressure is not applied. In this situation, being subjected to the action of the spring member 34, the movable abutting member 33*a* comes into abutment with the cam face 31*a* of the rotor 31, and the rotor 31 together with the chuck unit 4 moves forward (second position) inside the body cylinder. Next, FIG. 12 shows a situation in the middle of operation in the case where the writing pressure is applied. By the action of writing pressure, the rotor 31 moves backward via the chuck unit 4 inside the body cylinder. Thus, the movable abutting member 33*a* moves backward while compressing the spring member 34, and further the cam face 31*a* formed at the rotor 31 comes into abutment with the fixed abutting member 32*a*.

Figure 13:
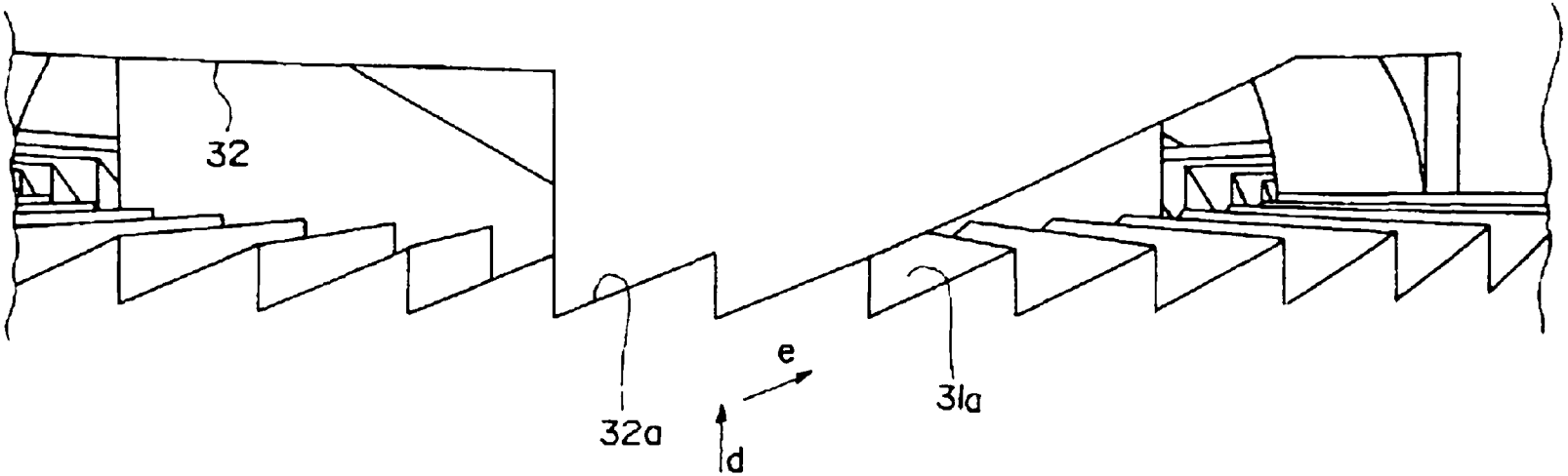
FIG. 13 is a partially enlarged view similarly showing a situation in the last operation in the case where the writing pressure is applied.

Next, FIG. 13 shows a situation where the rotor 31 (cam face 31*a*) is moved back (first position) further after being subjected to the writing pressure. The cam face 31*a* is pushed against the fixed abutting member 32*a* as shown by arrow d and a sawtooth-like face of the cam face 31*a* relatively moves in a direction as shown by arrow e with the result that the rotor 31 is subjected to the rotational drive corresponding to a horizontal component of force shown by arrow e.

Thus, the chuck unit 4 is also rotationally driven in the same direction, and the writing lead 10 grasped by the chuck unit 4 is rotated similarly. In addition, in this situation, although not shown in FIG. 13, the isosceles triangle-like movable abutting member 33*a* passes over one tooth at the sawtooth-like cam face 31*a*, and is brought into abutment with a sawtooth-like face of the next tooth in a direction of rotation.

Figure 14:
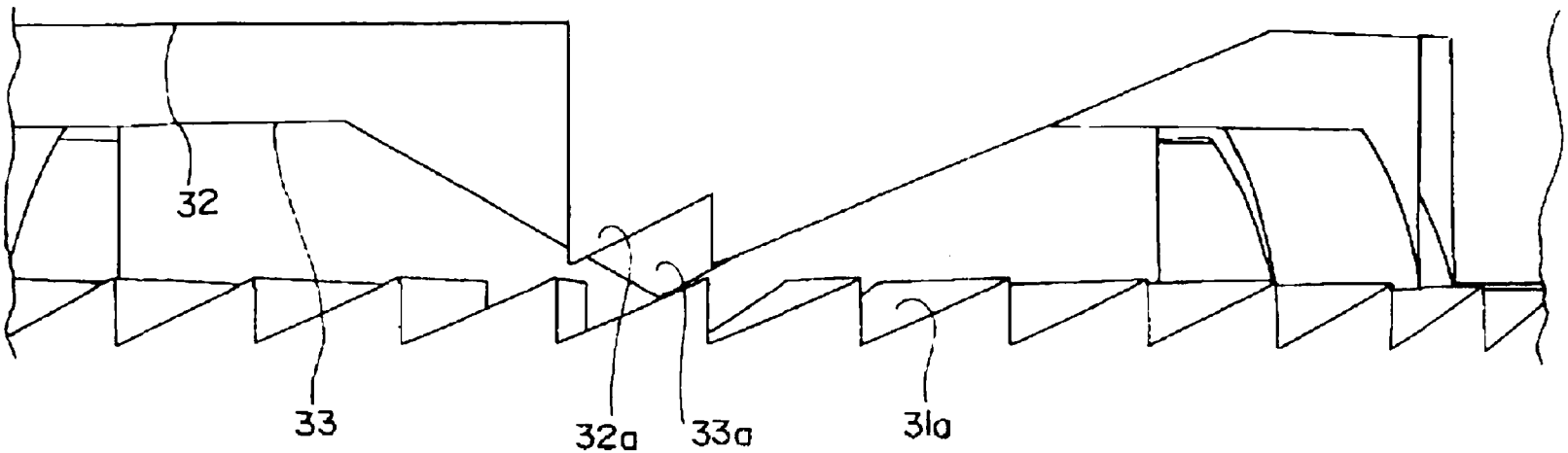
FIG. 14 is a partially enlarged view similarly showing a situation in the middle of operation in the case where the writing pressure is released.
Figure 15:
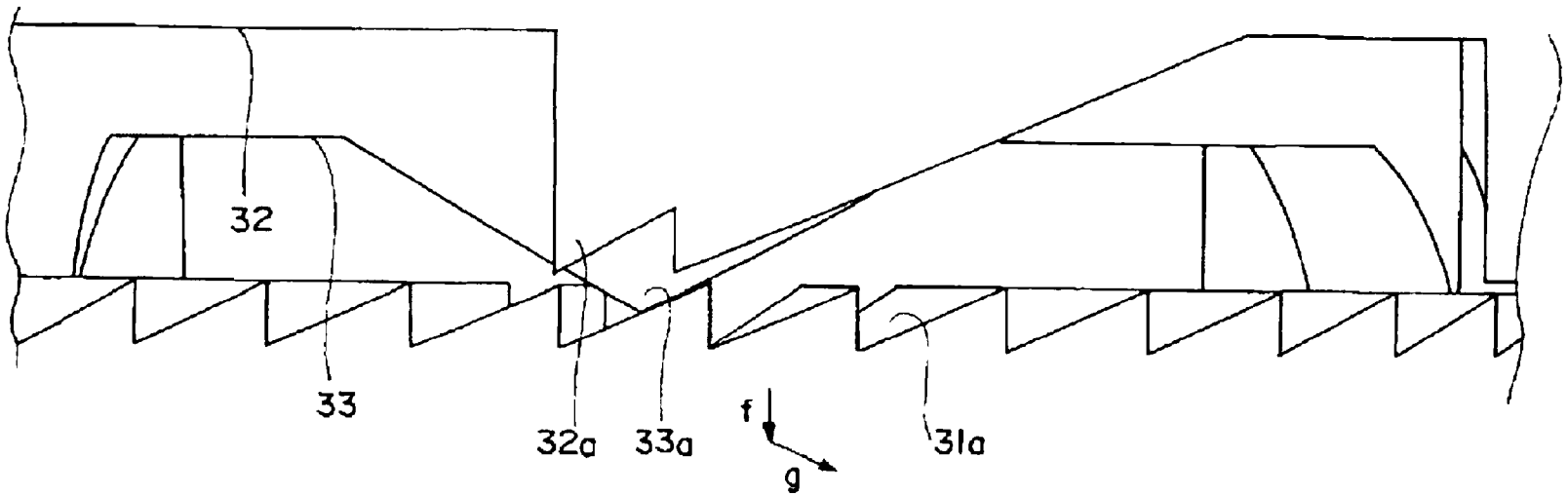
FIG. 15 is a partially enlarged view similarly showing a situation in the last operation in the case where the writing pressure is released.

FIG. 14 shows an initial situation where the writing pressure is released. The movable abutting member 33*a* which is subjected to the action of the spring member 34 moves forward, thereby releasing the meshing of the sawtooth-like cam face 31*a* with the fixed abutting member 32*a*. As shown in FIG. 15, when the movable abutting member 33*a* is still subjected to the action of the spring member 34 and moves forward, a slope of the movable abutting member 33*a* is pushed against the cam face 31*a* as shown by arrow f, so that the sawtooth-like face of the cam face 31*a* relatively moves in a direction shown by arrow g. As a result, the rotor 31 is subjected to the rotational drive corresponding to a horizontal component of force as shown by arrow g.

Therefore, the chuck unit 4 is also rotationally driven in the same direction, and the writing lead 10 is rotated similarly. In other words, one operation cycle of the application and release of the writing pressure causes the rotor 31 to be stepped corresponding to one sawtooth of the cam face 31*a*. By repeating this operation, the writing lead 10 is rotationally driven stepwise. Therefore, it is possible to prevent the writing lead from locally abrading as the writing proceeds, and also possible to obtain the operational effect similar to that in the first embodiment as already described.

In addition, in the above-mentioned third embodiment, the second cylindrical member 33 arranged to be slidable in the axial direction operates to play the role of the torque canceller as described in the above-mentioned first and second embodiments. In other words, the second cylindrical member 33 is interposed between the rotor 31 and the spring member 34, and operates to prevent the rotational motion of the rotor 31 from being transmitted to the spring member 34. Thus, it is possible to solve the problem that the back torsion (spring torque) of the spring member 34 occurs and places the obstacle to rotation operation of the rotor 31.

In the above-mentioned third embodiment, the spring member 34 shown in FIGS. 8 and 9 is used. In the case where the writing pressure is released, it is arranged that the bias force of the spring member 34 brings the movable abutting member 33*a* which is formed at the second cylindrical member 33, into abutment with the cam face 31*a* of the rotor 31 to apply the rotational motion to the rotor.

Thus, in the case where the spring member 34 is used, the rotation operation of the rotor is stabilized, which is preferred. However, the rotational operation of the rotor 34 in the case of the released writing pressure can be carried out by the weight of the second cylindrical member 33 without using the spring member 34. Thus, in the case of using gravity with respect to the second cylindrical member, it is possible to contribute to simplifying the mechanism and reduction in cost.

The invention claimed is:

1. A mechanical pencil arranged to grasp and release a writing lead by reciprocation of a chuck provided in a body cylinder so as to inch the writing lead forward, characterized in that a rotational drive mechanism is provided which is held within the body cylinder so as to be rotatable about a lead axis in which a rotor is retreated and moved forward by writing pressure of the writing lead so as to rotationally drive the rotor, and the writing lead may be rotated by the rotational drive mechanism, and in that the rotor which constitutes the rotational drive mechanism is formed into the shape of a ring, first and second cam faces are respectively formed at one end face and another end face of the rotor in an axial direction, and first and second fixed cam faces are arranged on the body cylinder side so as to face the first and second cam faces, respectively.

2. The mechanical pencil as claimed in claim 1, the first cam face in the ring-shaped rotor is brought into abutment with and meshed with the first fixed cam face by retreat operation of the writing lead by way of the writing pressure, and the second cam face in the ring-shaped rotor is brought into abutment with and meshed with the second fixed cam face by releasing the writing pressure, the second cam face on the rotor side and the second fixed cam face are arranged to have a phase-shifted relationship with respect to one tooth of a cam in the axial direction in a situation where the first cam face on the rotor side is meshed with the first fixed cam face, and the first cam face on the rotor side and the first fixed cam face are arranged to have the phase-shifted relationship with respect to one tooth of the cam in the axial direction in a situation where the second cam face on the rotor side is meshed with the second fixed cam face.

3. The mechanical pencil as claimed in claim 2, characterized by comprising a spring member for biasing the second cam face of the ring-shaped rotor into abutment with the second fixed cam face and bringing the second cam face and the second fixed cam face to mesh with each other in a situation where the writing pressure is released.

* * * * *